United States Patent [19]

Steigerwald

[11] 4,310,824

[45] Jan. 12, 1982

[54] ROTARY VARIABLE RESISTOR

[75] Inventor: Wolf-Erhard Steigerwald, Bad Neustadt, Fed. Rep. of Germany

[73] Assignee: Preh Elektrofeinmechanische Werke Jakob Preh Nachf. GmbH & Co., Bad Neustadt, Fed. Rep. of Germany

[21] Appl. No.: 38,826

[22] Filed: May 14, 1979

[30] Foreign Application Priority Data

May 27, 1978 [DE] Fed. Rep. of Germany ..... 2823285

[51] Int. Cl.[3] ..... H01C 10/34

[52] U.S. Cl. ..... 338/174; 338/184; 338/199

[58] Field of Search ..... 338/174, 162, 184, 199, 338/164, 197

[56] References Cited

U.S. PATENT DOCUMENTS

| | | | |
|---|---|---|---|
| 2,717,944 | 9/1955 | Daily et al. | 338/197 X |
| 2,736,781 | 2/1956 | Daily et al. | 338/184 X |
| 2,789,191 | 4/1957 | Arisman et al. | 338/164 X |
| 2,874,254 | 2/1959 | Daily et al. | 338/184 X |
| 2,917,721 | 12/1959 | Kelver et al. | 338/164 |
| 3,111,640 | 11/1963 | Dial | 338/184 X |
| 3,184,696 | 5/1965 | Snyder | 338/174 |
| 3,389,364 | 6/1968 | Budd et al. | 338/174 |
| 3,579,169 | 5/1971 | Dickinson | 338/174 X |
| 3,588,778 | 6/1971 | Edwards, Jr. et al. | 338/174 X |
| 3,676,822 | 7/1972 | Slagg et al. | 338/174 X |
| 3,691,504 | 9/1972 | Puerner | 338/197 X |
| 3,748,626 | 7/1973 | Maurice | 338/162 |
| 3,761,858 | 9/1973 | Oka | 338/174 X |
| 3,997,865 | 12/1976 | George | 338/184 X |
| 4,037,188 | 7/1977 | Frey et al. | 338/174 |
| 4,051,453 | 9/1977 | Barden | 338/171 |
| 4,052,786 | 10/1977 | Hufford et al. | 29/610 R |

FOREIGN PATENT DOCUMENTS

| | | |
|---|---|---|
| 2213814 | 10/1972 | Fed. Rep. of Germany . |
| 1790163 | 5/1973 | Fed. Rep. of Germany . |
| 2519051 | 11/1975 | Fed. Rep. of Germany . |
| 1488267 | 10/1977 | United Kingdom . |

OTHER PUBLICATIONS

German Gebrauchsmuster No. 6918596, 5-7-69.

Preh, West German Utility Model No. 1,972,994, Jul. 1967.

*Primary Examiner*—C. L. Albritton

*Attorney, Agent, or Firm*—Schwartz, Jeffery, Schwaab, Mack, Blumenthal & Koch

[57] ABSTRACT

The invention concerns a variable resistor of modular design comprising a housing, a resistance element retained in the housing by means of a detent fastener and having a resistance guide way mounted on a carrier, and with terminal contact surfaces on extensions of the carrier, terminal pieces in electrical contact with the terminal contact surfaces, and a rotor rotatably mounted in the housing and a contact element connected for rotation with the rotor and in sliding contact with a collector element and the resistance element.

20 Claims, 11 Drawing Figures

41
13
4
27
29
1

I
9
13
4
I
1

(A-A)

ROTARY VARIABLE RESISTOR

BACKGROUND OF THE INVENTION

1. Field of the Invention

The invention relates to a rotary variable resistor of modular construction.

2. The Prior Art

A variable rotary resistor constructed in a modular design, such that several similar modules may be connected with each other, is already known. Each module consists of a pot-like housing with a front and a rear surface. In the housing, a spring carrier is rotatably supported by means of a shaft, with the shaft extending through a central opening of the housing. A contact spring is secured to the spring carrier and the contacts of the contact spring resiliently contact the resistance guide way and the collector guide way. The resistance guide way is fastened to a support plate forming a closure for the housing. The collector guide way is constructed in the form of a flat collector ring with central opening, and is located at the bottom of the pot-like housing, with the shaft protruding through the opening. The housing itself is connected by means of a locating plate with a threaded bushing flange.

Further, a variable rotary resistor with a pot-like housing, comprising a metal fastening bushing and a housing part of synthetic material equipped with resiliently-biased clamping jaws to hold the insulating support, is also known. The resistance guide way and the collector guide way are mounted with the associated connecting lugs, on the insulating support. Additionally, the spring carrier with its sliding contact is rotatingly supported in the insulating support. The rotary motion is transmitted from the actuating shaft to the spring carrier by means of a dog plate which engages a groove in the face of the actuating shaft and a helical recess in the spring carrier. The resistance part may thus be separated from the housing part easily and without being destroyed. Replacement is thus readily possible. A disadvantage of the device consists of the fact that the rotary resistor in the final analysis can be assembled from two standard parts only. This eliminates any possibility of further variations. Therefore, if changes are desired, for example concerning the connecting lugs, an entire new resistance part with altered connecting lugs must be manufactured. If a different resistance guide way is desired, then an entirely different resistance component must be manufactured. Thus, the fact that the rotating resistor may be assembled from only two standard parts, proves in the final analysis to be a disadvantage.

SUMMARY OF THE INVENTION

It is the object of the present invention to design a variable rotary resistor of modular design such that its individual parts are highly standardized and are suitable for automatic production and simple assembly.

The object is attained according to the invention by providing the housing on at least one of its narrow sides with an opening through which the rotor, the collector element, and the resistance element equipped with a snap or detent mechanism, cooperating with a snap-in device on an inner wall of the housing, may be placed into the interior space of the housing, the structural parts dimensioned such that they close the housing opening and that mechanically they form a modular unit together with the housing.

Further details of the invention are described below with the aid of the drawings.

BRIEF DESCRIPTION OF THE DRAWINGS

In the drawings, which are of enlarged scale.

THE PREFERRED EMBODIMENT

The embodiment represented in the Figures shows a simple variable rotary resistor in the so-called S configuration, suitable for use in printed circuits. The "S configuration" indicates that the actuating shaft is perpendicular to the printed circuit. By replacing certain individual parts, the variable resistor is readily converted to the P configuration or to a multiple variable resistor in, for example, tandem or duplo configurations. In a "P configuration," the actuating shaft is parallel to the printed circuit. A "duplo" configuration includes two coaxially arranged rotary resistors, one controlled by a hollow spindle, and one controlled by a solid spindle extending through the hollow one. When the resistance material comprises, for example, a cermet layer or a layer of conductive synthetic material on a suitable substrate, then by simple replacement of the resistance element, which represents a functional component, the entire spectrum of applications up to and including the most advanced technology may be covered.

Figure 1:
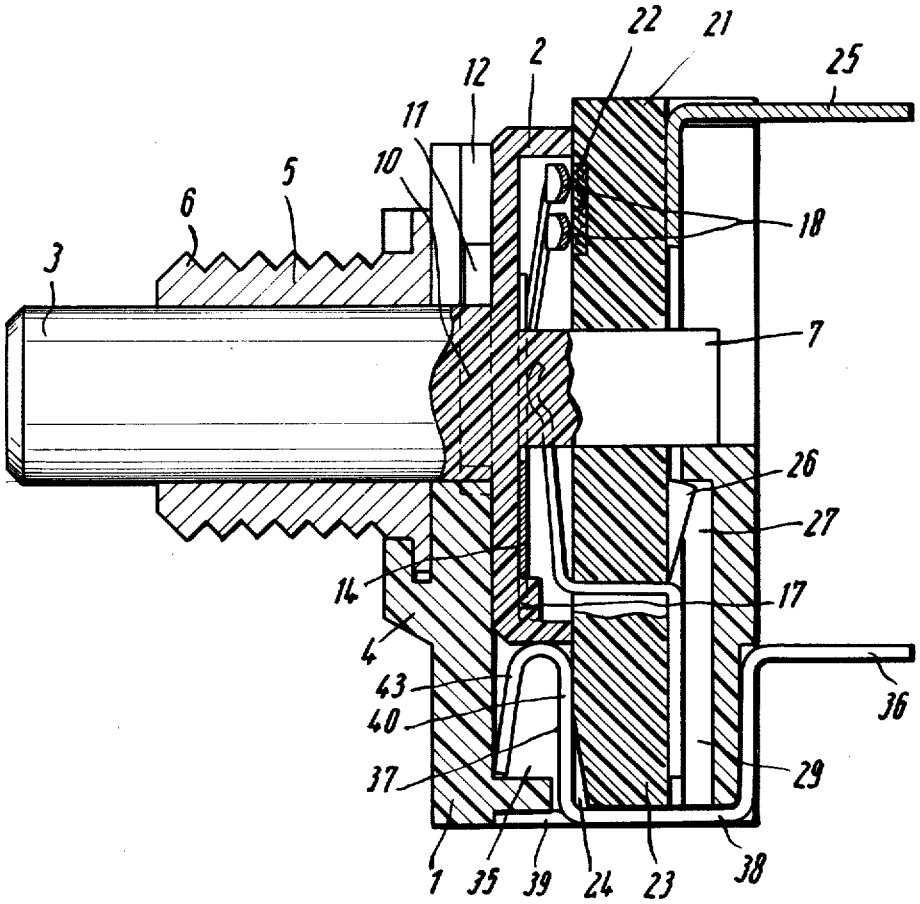
FIG. 1 shows a cross-sectional view of a rotary variable resistor.

In FIG. 1, the numeral 1 designates the housing of a rotary resistor shown in cross-sectional view. The housing is preferably of a synthetic material. A rotor 2 is rotatably supported in the housing, the rotor in the illustrated embodiment constructed integrally with an actuating shaft 3 of synthetic material. For the case wherein several housings are to be ganged together, for example, in a tandem arrangement, the rotor of the second rotary resistor is formed without an integral actuating shaft, and a dog or the like on the rotor of the first variable resistor cooperates with the rotor of the second variable resistor so that the rotor of the second variable resistor is entrained in the rotary motion. Each of the rotors is coupled directly or indirectly for rotation with an actuating shaft. This requires that each rotor have a shaft extension 7 which protrudes through the housing.

A projection 4 is integrally formed with the housing to receive and secure a bushing flange 5. The part of bushing flange 5 extending from the housing is provided with a thread 6. The projection 4 is omitted when the housing is to be used as a second rotary resistor in a multiple arrangement or as a trimmer resistance.

Figure 2:
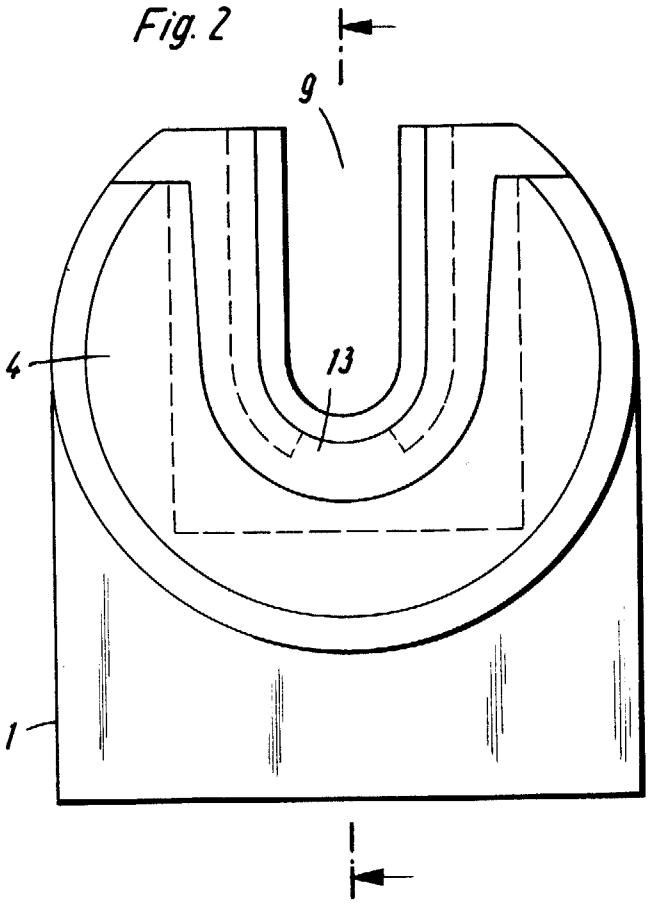
FIG. 2 shows a front elevational view of the housing of the variable rotary resistor.
Figure 4:
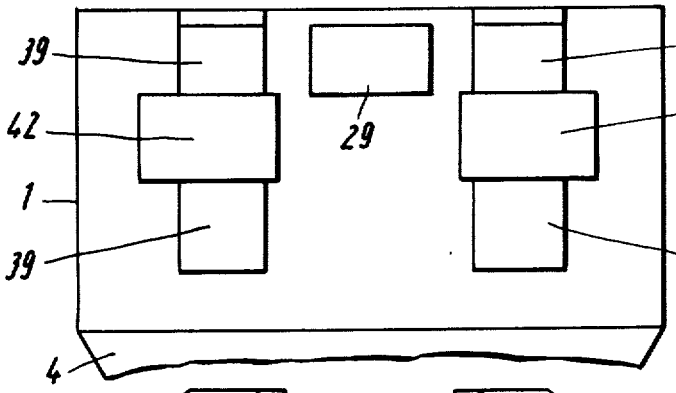
FIG. 4 shows a bottom view of the housing.

As seen in FIG. 2, the housing 1 has U-shaped notches 9 on each of its broad end walls; the notches extend inwardly from the edge and rotatably support in their curved parts the rotor shaft portions 7 and 10 which are located within the housing. A groove 12 extends on the inner face of one end wall of the housing parallel to the U-shaped notch adjacent to the actuating shaft, groove 12 being limited adjacent the curved portion of notch 9 by a protruding stop segment 13. Shaft extension 10 possesses a stop 11 to limit the rotary motion, integrally formed in a single piece with shaft extension 10 and cooperating with the edges of the stop segment 13 in limiting the rotation.

Figure 10:
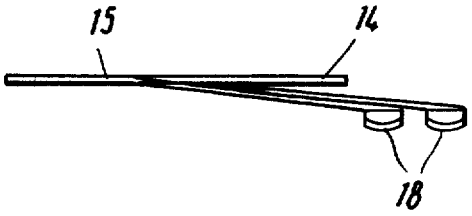
FIG. 10 shows an elevational view of a contact element.
Figure 11:
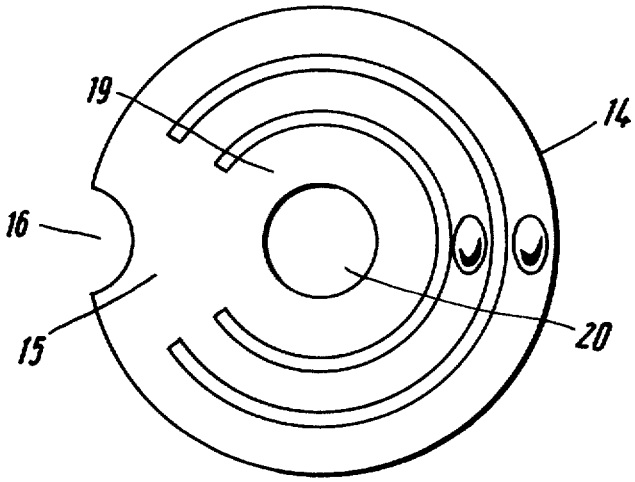
FIG. 11 shows a top view of the contact element of FIG. 10.

The rotor itself is plate-shaped, and has a contact spring 14 fastened to its interior. The contact spring, as shown in FIGS. 10 and 11, is generally circular in shape and has a contact spring base part 15, containing a recess 16. The contact spring is secured on a projection 17 located inside the rotor by means of the recess. From the base part 15, two arms of the spring lead outwardly in a parallel manner in each direction from the sides of the contact members 18 proper, which in the embodiment represented in the Figures consist of trough-like impressions. The choice of the contact member depends to a large extent on the resistance layer used. A center part 19 having a circular opening 20 in its center is connected with the base part, such that in the assembled state (as in FIG. 1) the shaft extension 7 of the rotor 2 extends through the opening 20.

Resistance element 21 also has a circular opening through which the shaft extension 7 of the rotor protrudes as well. The resistance element comprises a support made of an insulating material, upon which a resistance guide way 22 is arranged in accordance with conventional technology. Depending on the application, the insulating material may be a ceramic or synthetic substance; in the case of ceramics, a thick-film layer or cermet layer may be used, while with synthetics a conducting synthetic material may be selected as the resistance material. Two shoulders 23, having bevels 24, are provided on resistance element 21. The resistance element, the rotor and a collector element 25 are secured in the housing by means of a snap or detent mechanism on the resistance element. The snap or detent mechanism consists of a detent 26 protruding from the surface of the support. The detent cooperates with a recess 27 in the housing, located on the inner surface of one of the broad faces of the housing. Obviously, the inverse solution, whereby the housing carries the detent and the resistance element support is provided with a recess to receive the detent, is also conceivable.

Figure 8:
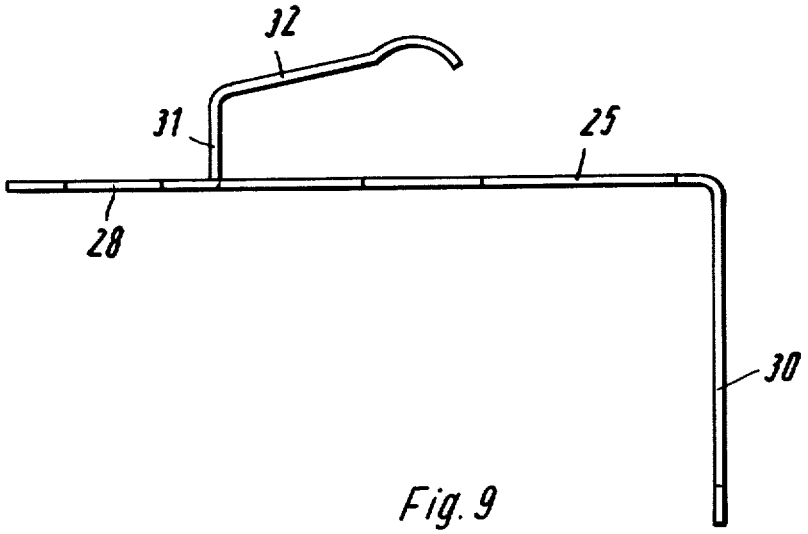
FIG. 8 shows a side elevational view of a collector element.
Figure 9:
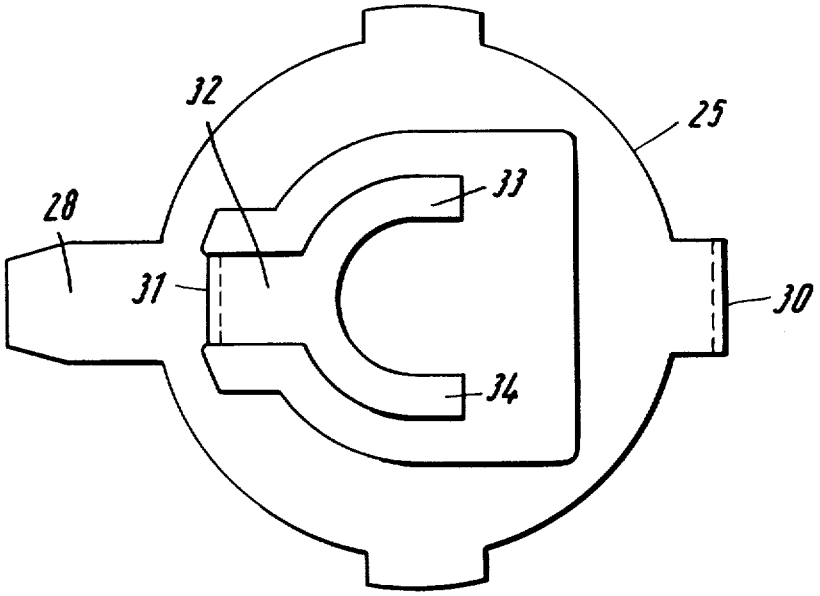
FIG. 9 shows a top view of the collector element of FIG. 8.

Between the resistance element 21 and one of the broad sides of the housing is an approximately circular collector element 25, constructed as a metal piece with flat surfaces. The collector element itself is shown in FIGS. 8 and 9. An extension 28 protruding radially outwardly is provided on one of the four sides of the collector elements, whereby the collector element may be positioned in a recess 29 of the housing. An extension of recess 29 simultaneously constitutes the locking recess 27 for detent 26. The collector element is further equipped with a soldering lug 30, extending at a right angle to the body of the collector element. The dimensions of the collector element correspond approximately to those of the resistance element. On the side of collector element 25 opposite soldering lug 30, a base part 31 of the collector element is bent at a right angle to the main body body portion of the collector element. Contact part 32 is formed by a further bend in part 31. The contact part 32 has a somewhat semicircular configuration, whereby the two free ends 33 and 34 are slightly curved and, when assembled in the variable resistor, are resiliently biased against the center part 19 of the contact spring 14 as shown in FIG. 1. In addition, the two free ends 33 and 34 partially encircle the rotor shaft extension 7.

Chambers 35 are formed in the bottom part of the housing 1, wherein the connecting terminals 36 are contained. Each connecting terminal 36 consists of a spring member 37, and a soldering lug 38 which protrudes from the housing. To guide and secure the connecting terminal, the spring member and the soldering lug are supported by grooves 39 provided in the outside wall of the housing, the depth of the grooves being such that the portion of the connecting terminal lying in the groove 39 does not protrude above the surface of the housing. Depending on the desired position of the housing when installed in the printed circuit, and thus whether configuration P or S of the rotary resistor is required, the soldering lug is provided with several bends, as needed. The spring member 37 comprises a U-shaped leaf spring which has a first arm 43 resting on the wall of housing chamber 35, and a second arm 40 resiliently biased against the terminal contact surface of the resistance guide way, not shown. The curvature of the spring member faces toward the resistance element. The side of the resistance element facing the spring member constitutes a type of guide surface, which cooperates with a bevel 24 at the edge of the resistance element during the insertion of the resistance element and the other components in the housing.

Figure 3:
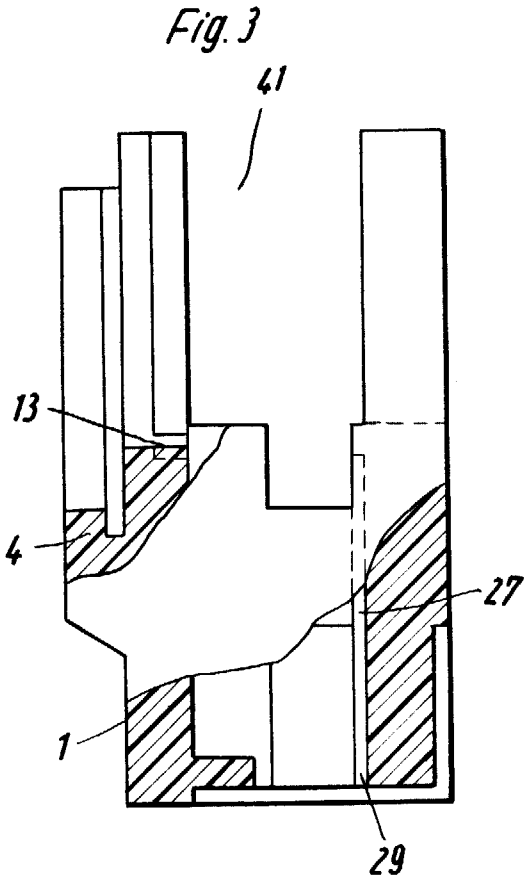
FIG. 3 shows a side elevational view of the housing in partial cross-section.

The housing, as seen in FIG. 3, has an opening 41 in its narrow side, by which the resistance element, the rotor and the contact element may be introduced in the housing. The individual elements are dimensioned so that they close off the housing, thus providing a certain degree of protection against foreign effects from the outside.

Figure 6:
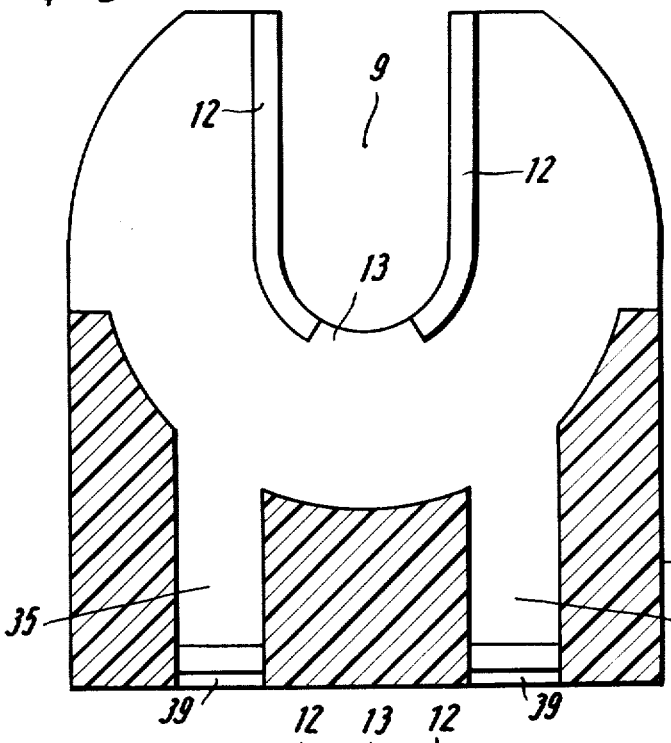
FIG. 6 shows the housing in a cross-sectional view taken in the direction of arrows B—B of FIG. 5.
Figure 5:
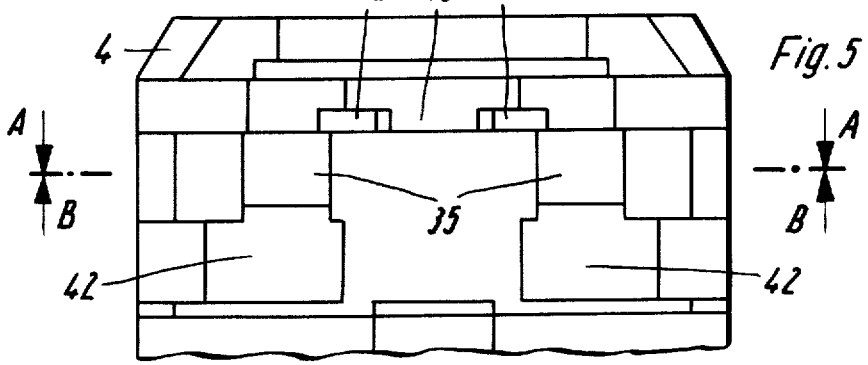
FIG. 5 shows a top view of the housing.
Figure 7:
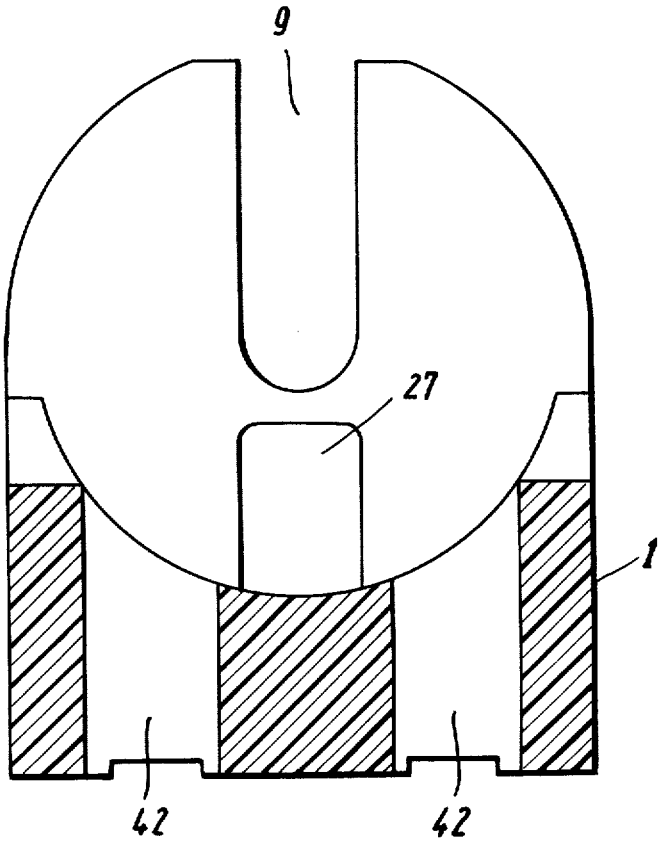
FIG. 7 shows the housing in a cross-sectional view taken in the direction of arrows A—A of FIG. 5.

As can be seen from FIGS. 6 and 7, the interior space has a semicircular configuration at the bottom part of the housing, with a radius approximately corresponding to that of the rotor. Chambers 35 comprise cutouts provided in this bottom part. Adjacent to chambers 35, passages 42 are provided in the bottom part of the housing; the terminal parts are introduced in the chambers 35 by way of passage 42, with passages 42 subsequently accepting the shoulders 23 of the resistance element.

The rotary resistor is assembled as follows:

The resistance element is inserted until it reaches the stop on the base part of the collector element. Subsequently, the rotor is inserted with one of its shaft extensions passing through the opening of the resistance element. This unit is inserted through housing opening 41 into the housing, and snapped into position, following the insertion of the terminal pieces in the chambers 35 of the housing.

I claim:

1. A rotary variable resistor of modular construction, comprising:

a generally u-shaped housing defining a mouth;

a resistance element within said housing, having a carrier, a resistance guide way disposed on said carrier, and terminal contact surfaces;

terminal members in electrical contact with said terminal contact surfaces;

a rotor supported for rotation within said housing;

a collector element;

a contact element coupled for rotation with said rotor and in sliding contact with said collector element and said resistance element, said housing permitting said rotor, said collector element, and said resistance element to be inserted into said mouth in a direction generally perpendicular to the axis of rotation of said rotor, said housing and said resistance element having means for retaining said resistance element in position in said housing; said rotor, said collector element, and said resistance element dimensioned to substantially close said housing opening and to form, when received and retained in position in said housing, a structural unit with said housing, and a threaded bushing flange, said housing including projection means for receiving and retaining said bushing flange on said housing.

2. The variable resistor of claim 1, wherein said rotor includes shaft extensions extending substantially perpendicular to the plane of rotation of said rotor, and said housing includes end walls substantially parallel to the plane of rotation of said rotor, said end walls having edges terminating at said housing opening and U-shaped recesses extending inwardly of said edges, said shaft extensions being rotatably supported in said recesses.

3. The variable resistor of claim 2, further comprising a groove in one of said end walls adjacent the recess thereof, said groove terminating in a stop segment, one of said shaft extensions having a stop extending into said groove for limiting rotation of said rotor when said stop contacts said stop segment.

4. The variable resistor of claim 1, wherein said rotor includes an integrally joined actuating shaft.

5. The variable resistor of claim 1, wherein said housing defines an interior space having a semicircular configuration opposite the mouth of said housing.

6. The variable resistor of claim 1, wherein said collector element comprises a substantially planar main body portion located between and substantially coparallel with said resistance element and a wall of said housing, and extension means projecting radially outwardly of said main body portion for engaging a recess in said housing and for serving as a soldering lug.

7. The variable resistor of claim 6, wherein said collector element further comprises a base part at an approximately right angle to said main body portion, and a contact part at an obtuse angle to said base part.

8. The variable resistor of claim 7, wherein said main body portion lies on one side of said resistance element, and said base part and contact part extend partially around said resistance element.

9. The variable resistor of claim 7, wherein said contact part comprises two free ends defining a semicircular leaf spring, each free and being slightly bent so as to slide freely on and be resiliently biased against said contact element.

10. A rotary variable resistor of modular construction, comprising:

a generally u-shaped housing defining a mouth;

a resistance element within said housing, having a carrier, a resistance guide way disposed on said carrier, and terminal contact surfaces;

terminal members in electrical contact with said terminal contact surfaces;

a rotor supported for rotation within said housing;

a collector element; and a contact element coupled for rotation with said rotor and in sliding contact with said collector element and said resistance element, said rotor including shaft extension means extending outwardly of said rotor and through respective openings in said housing, said resistance element, and said collector element, said housing permitting said rotor, said collector element, and said resistance element to be inserted into said mouth in a direction generally perpendicular to the axis of rotation of said rotor, said housing and said resistance element having means for retaining said resistance element in position in said housing; and said rotor, said collector element, and said resistance element dimensioned to substantially close said housing opening and to form, when received and retained in position in said housng, a structural unit with said housing.

11. A rotary variable resistor of modular construction, comprising:

a generally u-shaped housing defining a mouth;

a resistance element within said housing, having a carrier, a resistance guide way disposed on said carrier, and terminal contact surfaces;

terminal members in electrical contact with said terminal contact surfaces;

a rotor supported for rotation within said housing, said rotor being substantially plate-shaped;

a collector element; and a contact element coupled for rotation with said rotor and in sliding contact with said collector element and said resistance element, said contact element comprising contact spring means secured to said rotor, said housing permitting said rotor, said collector element, and said resistance element to be inserted into said mouth in a direction generally perpendicular to the axis of rotation of said rotor, said housing and said resistance element having means for retaining said resistance element in position in said housing; and said rotor, said collector element, and said resistance element dimensioned to substantially close said housing opening and to form, when received and retained in position in said housing, a structural unit with said housing.

12. A rotary variable resistor of modular construction, comprising:

a generally u-shaped housing defining a mouth, and chamber means within said housing;

a resistance element within said housing, having a carrier, a resistance guide way disposed on said carrier, and terminal contact surfaces;

terminal members in electrical contact with said terminal contact surfaces, said terminal members each having a spring member received in said chamber means for providing electrical contact with said terminal contact surfaces;

a rotary supported for rotation within said housing;

a collector element; and a contact element coupled for rotation with said rotor and in sliding contact with said collector element and said resistance element, said housing permitting said rotor, said collector element, and said resistance element to be inserted into said mouth in a direction generally perpendicular to the axis of rotation of said rotor, said housing and said resistance element having means for retaining said resistance element in position in said housing; and said rotor, said collector element, and said resistance element dimensioned to substantially close said housing opening and to form, when received and retained in position in said housing, a structural unit with said housing.

13. The variable resistor of claim 12, wherein said resistance element carrier includes a shoulder at one edge thereof, said terminal members each having a guide surface for contacting said shoulder.

14. The variable resistor of claim 12, wherein said spring member comprises a U-shaped leaf spring having a first arm biased against a wall of said chamber means and a second arm biased against a said terminal contact surface of said resistance guide way.

15. The variable resistor of claim 12, wherein each of said terminal members includes a soldering lug integrally formed with said spring member, said terminal members being provided with a plurality of bends suitable to permit installation of said variable resistor in a circuit in a desired position.

16. The variable resistor of claim 12, further comprising passages extending into said housing for the introduction of said spring members into said chamber means, said resistance element including projections received in said housing passages.

17. The variable resistor of claim 16, wherein said housing further includes recesses adjacent said passages, whereby when a said spring member is received in said chamber means, a portion of the associated said terminal member is securely located in a said recess so as not to extend beyond the surface of said housing.

18. A rotary variable resistor of modular construction, comprising:

a generally u-shaped housing defining a mouth;

a resistance element within said housing, said resistance element including a bevelled shoulder portion having a carrier, a resistance guide way disposed on said carrier, and terminal contact surfaces;

terminal members in electrical contact with said terminal contact surfaces;

a rotor supported for rotation within said housing;

a collector element; and a contact element coupled for rotation with said rotor and in sliding contact with said collector element and said resistance element, said housing permitting said rotor, said collector element, and said resistance element to be inserted into said mouth in a direction generally perpendicular to the axis of rotation of said rotor, said housing and said resistance element having means for retaining said resistance element in position in said housing; and said rotor, said collector element, and said resistance element dimensioned to substantially close said housing opening and to form, when received and retained in position in said housing, a structural unit with said housing.

19. A rotary variable resistor of modular construction, comprising:

a generally u-shaped housing defining a mouth;

a resistance element within said housing, having a carrier, a resistance guide way disposed on said carrier, and terminal contact surfaces;

terminal members in electrical contact with said terminal contact surfaces;

a rotor supported for rotation within said housing;

a collector element, the diameter of said collector element being substantially equal to the diameter of said resistance element;

a contact element coupled for rotation with said rotor and in sliding contact with said collector element and said resistance element, said housing permitting said rotor, said collector element, and said resistance element to be inserted into said mouth in a direction generally perpendicular to the axis of rotation of said rotor, said housing and said resistance element having means for retaining said resistance element in position in said housing; and said rotor, said collector element, and said resistance element dimensioned to substantially close said housing opening and to form, when received and retained in position in said housing, a structural unit with said housing.

20. A rotary variable resistor of modular construction, comprising:

a generally u-shaped housing defining a mouth;

a resistance element within said housing, having a carrier, a resistance guide way disposed on said carrier, and terminal contact surfaces;

terminal members in electrical contact with said terminal contact surfaces;

a rotor supported for rotation within said housing;

a collector element; and a contact element coupled for rotation with said rotor and in sliding contact with said collector element and said resistance element, said housing permitting said rotor, said collector element, and said resistance element to be inserted into said mouth in a direction generally perpendicular to the axis of rotation of said rotor, said housing and said resistance element having means for retaining said resistance element in position in said housing, said retaining means comprising a detent member on said resistance element for cooperating with a locking recess provided in an internal face of a wall of said housing; and said rotor, said collector element, and said resistance element dimensioned to substantially close said housing opening and to form, when received and retained in position in said housing a structural unit with said housing.

* * * * *